US011739447B2

(12) United States Patent
Henssen

(10) Patent No.: US 11,739,447 B2
(45) Date of Patent: Aug. 29, 2023

(54) ABRASION RESISTANT FABRIC

(71) Applicant: DSM Protective Materials B.V., Geleen (NL)

(72) Inventor: Giovanni Joseph Ida Henssen, Echt (NL)

(73) Assignee: AVIENT PROTECTIVE MATERIALS B.V., Geleen (NL)

( * ) Notice: Subject to any disclaimer, the term of this patent is extended or adjusted under 35 U.S.C. 154(b) by 350 days.

(21) Appl. No.: 16/970,478

(22) PCT Filed: Feb. 28, 2019

(86) PCT No.: PCT/EP2019/055036
§ 371 (c)(1),
(2) Date: Aug. 17, 2020

(87) PCT Pub. No.: WO2019/166574
PCT Pub. Date: Sep. 6, 2019

(65) Prior Publication Data

US 2021/0079567 A1 Mar. 18, 2021

(30) Foreign Application Priority Data

Mar. 1, 2018 (EP) ..... 18159350

(51) Int. Cl.

| | |
|---|---|
| ***D03D 1/00*** | (2006.01) |
| ***D03D 15/00*** | (2021.01) |
| ***D03D 15/217*** | (2021.01) |
| ***D03D 15/283*** | (2021.01) |

(52) U.S. Cl.
CPC ..... *D03D 1/0041* (2013.01); *D03D 15/00* (2013.01); *D03D 15/217* (2021.01); *D03D 15/283* (2021.01); *D10B 2321/0211* (2013.01); *D10B 2401/00* (2013.01); *D10B 2401/063* (2013.01); *D10B 2501/00* (2013.01); *Y10T 442/30* (2015.04)

(58) Field of Classification Search
None
See application file for complete search history.

(56) References Cited

U.S. PATENT DOCUMENTS

| | | | | |
|---|---|---|---|---|
| 8,136,555 | B1 * | 3/2012 | Chang | D03D 11/00 139/384 R |
| 2010/0075557 | A1 | 3/2010 | Shteiyer | |
| 2016/0237198 | A1 * | 8/2016 | Tsukada | B32B 27/36 |

FOREIGN PATENT DOCUMENTS

| | | | |
|---|---|---|---|
| CN | 105723021 | 6/2016 | |
| CN | 105862227 | 8/2016 | |
| CN | 107083590 | 8/2017 | |
| WO | WO 2010/089410 | 8/2010 | |
| WO | 2015/071133 | 5/2015 | |
| WO | WO-2018227232 A1 * | 12/2018 | D02G 3/04 |

OTHER PUBLICATIONS https://patents.google.com/patent/CN105723021B/en?oq=CN105723021 (Year: 2016).*
https://patents.google.com/patent/CN105862227A/en?oq=CN105862227 (Year: 2016).*
https://patents.google.com/patent/CN107083590A/en?oq=CN107083590 (Year: 2017).*
International Search Report for PCT/EP2019/055036, dated Apr. 9, 2019, 4 pages.
Written Opinion of the ISA for PCT/EP2019/055036, dated Apr. 9, 2019, 7 pages.

* cited by examiner

*Primary Examiner* — Arti Singh-Pandey
(74) *Attorney, Agent, or Firm* — Nixon & Vanderhye P.C.

(57) ABSTRACT

The invention relates to a woven fabric comprising a weft yarn, an outer layer with warp yarn A and an inner outer layer with warp yarn B, wherein the weft yarn comprises a combination of individual yarns comprising UHMWPE yarns and individual natural yarns, the warp yarn A comprises at least 50 wt % of a natural fiber, and warp yarn B comprises a combination of individual UHMWPE yarns and individual natural yarns, and said outside and inside layer being at least partially interconnected by the weft yarn. The invention also relates to products comprising said woven fabric such as clothing, lining, sport apparel, and gloves.

15 Claims, No Drawings

ABRASION RESISTANT FABRIC

This application is the U.S. national phase of International Application No. PCT/EP2019/055036 filed 28 Feb. 2019, which designated the U.S. and claims priority to EP Patent Application No. 18159350.0 filed 1 Mar. 2018, the entire contents of each of which are hereby incorporated by reference.

The invention relates to a woven fabric comprising ultra-high molecular weight polyethylene (UHMWPE) fibers and natural fibers. The invention also relates to the use of the fabric and to articles comprising the fabric such as clothing, sport apparel, and gloves.

Such a woven fabric is known from US2010/0075557A1. This document discloses a woven fabric having a first surface and a second surface, the fabric comprising three types of warp yarns that are interlaced with weft fibers. The first warp fibers may be aesthetic fibers, e.g. natural fibers, cotton, wool, rayon, polyamide fibers, high modulus fibers; the second wrap may be performance fibers, e.g. high molecular weight polyethylene, aramid, carbon fiber, fiberglass; the third wrap fibers include comfort providing qualities, e.g. cotton, rayon, wool, polyester, nylon. The weft fibers may include stretchable fibers and include Lycra® fibers, Spandex® fibers, Kevlar® fibers, high modulus polyethylene, wool, rayon, nylon, modacrylic fibers. EP3068933 discloses a woven fabric comprising a weft yarn and at most two warp yarns A and B, wherein the weft yarn comprises a high performance fiber; the warp yarn A comprises at least 50 wt % of a natural fiber; the warp yarn B comprises a high performance fiber; and wherein the fabric has an outside layer comprising the warp yarn A and an inside layer comprising the warp yarn B and said outside and inside layers being at least partially interconnected by the weft yarn.

These prior art fabrics are laborious to manufacture, amongst others since the warp yarn comprises a polyethylene fiber core and a helical wrapping of for example cotton. The manufacture of such warp yarn is a labor intensive and expensive process. Furthermore, such a yarn may encounter integrity loss of the helical wrapping. Such is not preferred from not only aesthetics but also from performance point of view.

An object of the present invention may be seen to provide a woven fabric which reduces the above-mentioned disadvantages, and in particular a fabric that is less sensitive to quality decay during use, while maintaining the wearing comfort of the fabric. Additionally, an object may be to provide improved abrasion resistance combined with comfort, especially after prolonged use and wear or friction, and in particular at lower amounts of high-performance polymer fibers in the fabric.

The invention provides a woven fabric comprising a weft yarn and two warp yarns A and B, wherein the weft yarn comprises of a combination of a) individual yarns comprising UHMWPE yarns and b) individual yarns in the form of natural yarn, wherein the amount of yarns comprising UHMWPE yarns in the weft yarn is between 33 and 66 wt % of the total amount of the weft yarn; the warp yarn A comprises at least 50 wt % of a natural fiber; the warp yarn B comprises a combination of individual UHMWPE yarns and individual yarns in the form of natural yarn, with the amount of UHMWPE yarn being between 10-50 wt % of the total amount of the warp yarn B; and wherein the fabric has an outside layer comprising the warp yarn A and an inside layer comprising the warp yarn B and said outside and inside layers being at least partially interconnected by the weft yarn.

It was observed that the woven fabric of the invention may show improved manufacturing efficiency. It was further observed that the fabric of the invention has an equal or improved resistance to abrasion and may have an improved wearing comfort especially after prolonged use and wear or friction, and in particular at lower amounts of high-performance polymer fibers in the fabric. Especially when e.g. trousers or jeans are made with the woven fabric of the invention, wearing comfort after friction or abrasion due to falling or sliding may still be good. An alternative embodiment of the invention relates to a woven fabric comprising a weft yarn and at least two warp yarns A and B, preferably two warp yarns A and B, wherein the weft yarn consists of a combination individual yarns comprising UHMWPE yarns and individual yarns in the form of natural yarn, the amount of UHMWPE yarn is between 33 and 66 wt % of the total amount of the weft yarn; the warp yarn A comprises at least 50 wt % of a natural fiber; the warp yarn B comprises or consists of a combination of individual UHMWPE yarns and individual natural yarns, with the amount of UHMWPE yarn being between 10 and 50 wt % of the total amount of the warp yarn B; and wherein the fabric has an outside layer comprising the warp yarn A and an inside layer comprising the warp yarn B and said outside and inside layers being at least partially interconnected by the weft yarn.

By warp yarn is herein understood a multitude of yarns, and may be also referred to as warp system. Each warp yarn runs substantially lengthwise, in the machine direction of the fabric. The warp yarns in the woven fabric of the invention are distinguished by their mutual positions in the fabric. The warp yarns A and B are forming an outer and inner layer, respectively, as explained hereinafter. Warp yarns that form the outer layer are warp yarns A, while warp yarns that form the inner layer are warp yarns B. Individual warp yarns in one layer do not need to be of the same composition as detailed further below. Such position within the fabric can be achieved by techniques as such known to the skilled person. One method may be to provide multiple warp yarns to a weaving process through beams with specific chosen warp yarn(s) per beam, which method has increased manufacturing flexibility. Alternatively, this may also be done via a single beam with the different warp yarns being organized next to each other. The position of the warp yarns within the fabric is herein referenced in relation through the thickness of the fabric. A fabric is a three-dimensional object wherein the thickness is typically much smaller than the two other dimensions: the length (or the warp) direction and the width (or weft direction). Typically, the length is only limited by the length of the warp yarns whereas the width of a fabric is mainly limited by the count of individual warp yarns and the width of the weaving machine employed. The position of the two warp yarns is defined according to their position across the thickness of the fabric, whereby the thickness is delimited by an outside and an inside surface. The 'outside' and 'inside' surface of the fabric therefore form two distinguishable surfaces. In end-use applications such as e.g. garments, the outside surface of the fabric may, for example, be oriented towards an external environment. And the inside surface may be oriented towards for example a human body that is to be protected from, for example, abrasion.

An outside and an inside layer are herein defined through the thickness of the fabric whereby the outside layer comprises the outside surface and the inside layer comprises the inside surface. Layers are defined to be volumes that extend substantially parallel to the respective fabric surfaces and having a thickness of 50% or less of the total thickness of the fabric.

The weft yarn generally refers to the yarns oriented in a cross-wise direction, transverse to the machine direction of the fabric, and may be also referred herein to as weft yarn system. In a weaving sequence of the fabric, each weft yarn repeatedly passes between two adjacent warp yarns, switching between the sides of the planes formed by the respective warp yarns A or B and results in interlacing or interconnection between said warp yarns but also between the outside and inside layers comprising said warp layers, respectively. The angle formed between the warp yarns and the weft yarn is preferably about 90°. The fabric comprises a combination of individual UHMWPE yarn and individual yarns in the form of natural yarn. The terms "individual natural yarns" or "individual yarns in the form of natural yarn" means herein individual yarns consisting of natural yarns. Such individual weft yarns may have different compositions. It was observed that the combination of the individual fibers comprising UHMWPE fibers and the individual natural fibers in the weft create a good balance between abrasion resistance of the fabric and comfort, whereby (wearing) comfort, especially after prolonged use and wear/friction, may not deteriorate too much. Friction may occur e.g. while a person is falling off a running motorcycle and subsequently sliding on the (concrete) road resulting in abrasion. The friction/abrasion may result deterioration of the woven fabric resulting in reduced wearing comfort.

The weave structure formed by the warp yarns and the weft yarns can be of multiple types, depending upon the number and diameters of the employed warp yarns and weft yarns as well as on the weaving sequence used between the warp yarns and the weft yarns during the weaving process. Such different sequences are well known to the person skilled in the art. Through the weaving process the weft yarn interweaves the warp yarns A and B, hereby at least partially interconnecting the outside and inside layers comprising respectively said warp yarns, A and B. Such interweaved structure may also be called a monolayer fabric, being composed of sub layers as described above. The individual inside and outside layers may present, once the interwoven character via the weft yarn is disregarded, the typical weave structures for fabrics such as plain weave, twill weave and satin weave. An advantage of the weave structure of the fabric of the present invention is that both surfaces of the fabric may have distinguishable or the same weave structures independently selected from the weave structure of the other surface, which is not possible for weaves consisting of only one warp and one weft yarn.

A weave structure is typically characterized by a float, a length of the float and a float ratio. The float is a portion of a weft yarn delimited by two consecutive points where the weft yarn crosses the virtual plane formed by the respective warp yarns A or B. The length of the float expresses the number of warp yarns that the float passes between said two delimiting points. Typical lengths of floats may be 1, 2 or 3, indicating that the weft yarn passes 1, 2 or 3 warp yarns before crossing the virtual plane formed by the warp yarns by passing between 2 adjacent warp yarns. The float ratio is the proportion between the lengths of the floats of the weft yarn on either side of the plane formed by the warp yarns. Preferably the weave structure of the outside layer has a float ratio of 3/1, 2/1 or 1/1. Most preferably the float ratio is 3/1 resulting in a jeans aspect of the outside layer. The weave structure for the inside layer may be chosen independent form the outside layer and be optimized for improved abrasion resistance or comfort. Depending upon the composition of the warp yarn B and the weft yarn, the weave structure of the inside layer preferably has a float ratio of 3/1, 2/1 or 1/1, most preferably the float ratio is 1/1.

The expression 'at least partially interconnected', herein means that the ratio between the number of crossings a weft yarn performs through the virtual plane formed by the warp yarn A to the number of crossings said weft yarn performs through the virtual plane formed by the warp yarn B is at most 4:1, preferably at most 3:1, more preferably at most 2:1, and most preferably at most 1:1. 'At least partially interconnected' may be also referred herein interchangeably as 'interconnected'.

Fiber is herein understood to be an elongated body having a length, a width and a thickness, the length dimension of which is much greater than its transverse dimensions of width and thickness. The term fiber also includes various embodiments e.g. a filament, a ribbon, a strip, a band, a tape and the like having regular or irregular cross-sections. The fibers may have continuous lengths, known in the art as filaments, or discontinuous lengths, known in the art as staple fibers. Natural fibers typically are staple fibers. Synthetic staple fibers are commonly obtained by cutting or stretch-breaking filaments of corresponding synthetic fibers. The fibers may have various cross-sections, e.g. regular or irregular cross-sections with a circular, bean-shape, oval or rectangular shape. A yarn, in this invention, is an elongated body containing a plurality of fibers. The skilled person may distinguish between continuous filament yarns or filament yarns which contain many continuous filament fibers and staple yarns or spun yarns containing short fibers also called staple fibers.

The two warp yarns, A and B, may further be distinguished by their yarn composition within a yarn, or between different individual yarns. Warp yarn A comprises at least 50 wt % of a natural fiber, preferably at least 75 wt % of a natural fiber, more preferably at least 90 wt % of a natural fiber. Most preferably, the warp yarn A substantially consists of a natural fiber. In the context of the present application natural fibers are understood to be naturally occurring fibers such as cotton, hemp, wool, silk, jute, and linen. Appealing fabrics with appreciated texture and haptic properties are obtained when the natural fiber of the warp yarn A in the fabric according to the present invention is cotton or wool. Warp yarn B consists of a combination of individual UHMWPE yarn and individual yarns in the form of natural yarn, the amount of UHMWPE yarn is between 10 and 50 wt % of the total amount of the warp yarn B.

UHMWPE is a polyethylene having an intrinsic viscosity (IV) of at least 4 dl/g, more preferably at least 8 dl/g, most preferably at least 12 dl/g. Preferably the IV is at most 40 dl/g, more preferably at most 30 dl/g, more preferably at most 25 dl/g. Preferably, UHMWPE fibers are gel-spun fibers, i.e. fibers manufactured with a gel-spinning process. Examples of gel spinning processes for the manufacturing of UHMWPE fibers are described in numerous publications, including EP 0205960 A, EP 0213208 A1, U.S. Pat. No. 4,413,110, GB 2042414 A, GB-A-2051667, EP 0200547 B1. EP 0472114 B1, WO 01/73173 A1, EP 1,699,954 and in "Advanced Fiber Spinning Technology", Ed. T. Nakajima, Woodhead Publ. Ltd (1994), ISBN 185573 182 7. Preferably, the UHMWPE fibers in the present invention have a tenacity of at least 2 N/tex, more preferably at least 3 N/tex.

In addition, to the at least 50% natural fiber, warp yarn A may further contain synthetic fibers of e.g. polyamides, polyesters, polytetrafluoroethylene, polyolefins, polyvinyl alcohols and polyacrylonitriles; and/or high performance fibers; and/or other natural fibers than cotton, hemp, wool, silk, jute, linen. In a further preferred embodiment, in warp yarn A may further comprise high performance fiber chosen from the group of polyaramides fibers and polyolefin, preferably polyethylene and most preferably UHMWPE fibers. It was observed that when the warp yarn A of the weave additionally comprises high performance fibers, more in particular high performance aromatic polyamide or polyolefin fibers, more in particular poly(p-phenylene terephthalamide), the woven fabric of the invention has further improved abrasion resistance. Preferably, the warp yarn A comprises between 0.5 and 25 wt % (based on the total amount of warp yarns A) of a high performance fiber, more preferably between 1 and 20 wt %, even more preferred between 2 and 10 wt % of a high performance fiber.

Warp yarn B comprises a combination of individual UHMWPE yarn and individual yarns in the form of natural yarn, the amount of UHMWPE yarn is between 10 and 50 wt % of the total amount of the warp yarns B. It was observed that increasing levels of UHMWPE fibers in the warp yarn B does not necessarily further improve the abrasion resistance of the fabric, while improved abrasion resistance combined with comfort, especially after prolonged use and wear/friction may get worse. An optimum to this was found between 10 and 50 wt % of the total amount of UHMWPE warp yarns B especially when individual UHMWPE yarns and natural yarns are used an alternating fashion. A preferred natural fiber is cotton. Wearing comfort may be further increased when warp yarn B comprises at least one fiber selected from the group comprising hemp, wool, silk, jute, linen and synthetic fibers of polyamides, polytetrafluoroethylene, polyesters, polyolefins, polyvinyl alcohols and polyacrylonitriles.

It was noticed that the balance between wearing comfort and abrasion resistance of the fabric is further improved when the warp yarn B is a spun yarn. A further advantage is that the composition of a spun yarn can easily be adjusted to any desired ratio that allows further improvement or optimization of the abrasion and comfort.

The spun yarn may be manufactured by any technique known in the art such as ring spinning process or open-end spinning process. An advantage of applying the ring spinning process is that the mechanical treatment and process temperature are very suitable for UHMWPE staple fibers.

In the context of the present invention, high performance fibers are understood to include fibers comprising or consisting of a polymer selected from a group comprising polyolefins, polyoxymethylene; poly(vinylidene fluoride); poly(methylpentene); poly(ethylene-chlorotrifluoroethylene); polyamides and polyaramides, e.g. poly(p-phenylene terephthalamide); polyarylates; poly(tetrafluoroethylene) (PTFE); poly{2,6-diimidazo-[4,5b-4',5'e]pyridinylene-1,4 (2,5-dihydroxy)phenylene} (known as M5); poly(p-phenylene-2, 6-benzobisoxazole) (PBO); polyamide 6 or polyamide 6.6; polybutene; polyesters, e.g. poly(ethylene terephthalate), poly(butylene terephthalate), and poly(1,4 cyclohexylidene dimethylene terephthalate); polyvinyl alcohols and thermotropic liquid crystal polymers (LCP) as known from e.g. U.S. Pat. No. 4,384,016. Preferably, the high-performance fibers comprise or consist of thermoplastic polymers. Preferably, the high-performance fibers comprise or consist of semi crystalline polymers. More preferably, the high-performance fibers comprise polyamides, polyaramides, or polyesters. In one preferred embodiment, the high-performance fibers comprise polyamide 6; polyamide 6.6; poly(ethylene terephthalate), and poly(butylene terephthalate). In another preferred embodiment, the high-performance fibers comprise poly(p-phenylene terephthalamide).

Alternatively, high performance fibers may include polymeric fibers having a tenacity or tensile strength of at least 1.2 N/tex, preferably at least 2.2 N/tex, more preferably at least 2.8 N/tex even more preferably at least 3.5 N/tex, most preferably at least 4 N/tex. For practical reasons, the tenacity or tensile strength of the high performance fibers may be at most 7 N/tex.

In the present invention, the expression 'substantially consisting of' has the meaning of 'may comprise traces of further species' or in other words 'comprising more than 98 wt % of' and hence allows for the presence of up to 2 wt % of further species.

The weft yarn in the woven fabric of the invention comprises a combination of individual yarns comprising a UHMWPE yarn and individual natural yarns whereby the amount of the yarn comprising a UHMWPE yarn is between 33 and 66 wt % of the total amount of weft yarns. Preferably the amount of the yarns comprising a UHMWPE yarn is between 40 and 60 wt %, more preferably the amount of UHMWPE yarns is between 45 and 55 wt %. Most preferably amount of yarns comprising a UHMWPE yarn is about 50 wt %. Such gives a good balance between abrasion resistance, aesthetics and comfort.

The woven fabric of the inventions comprises a combination of individual yarns comprising a UHMWPE yarn and individual natural yarns. An individual yarn is a yarn that can be distinguished, e.g. visually from another, adjacent, yarn. These individual yarns may be clustered whereby e.g. several yarns comprising UHMWPE yarns are positioned next to each other. Such a cluster may comprise or consist of between 1-20 individual UHMWPE yarns, preferably between 1-10 individual yarns comprising UHMWPE yarns. In an alternative embodiment, the yarns comprising UHMWPE and natural yarns are arranged in an alternating fashion, whereby individual yarns comprising UHMWPE yarns are in contact with individual natural yarns. Such further improves abrasion resistance combined with comfort, especially after prolonged use and wear or friction. In a preferred embodiment, the warp yarns B are arranged in a clustered manner. Preferably for the warps B, a cluster may consist of between 1-20 individual UHMWPE yarns, preferably between 1-10 individual UHMWPE yarns.

Although further improved abrasion properties of the fabric are obtained by higher amounts of high performance fibers in the weft yarn, it was observed that the wearing comfort of the fabric according to the invention may be further improved by a weft yarn comprising at least one fiber selected from the group comprising cotton, hemp, wool, silk, jute, linen and synthetic fibers of polyamides, polytetrafluoroethylene, polyesters, polyolefins, polyvinyl alcohols and polyacrylonitriles and/or at least one continuous elastic filament.

Preferably, the weft yarn in the fabric according to the present invention comprises a combination of: individual natural yarns and 33 to 66 wt % of the total amount to weft yarns of individual yarns comprising UHMWPE yarns, synthetic fibers, and/or at least one continuous elastic filament. More preferably, the weft yarn comprises a combination of: individual natural yarns and individual yarns consisting of UHMWPE yarns, preferably UHMWPE spun yarns, synthetic fibers, preferably synthetic continuous fibers that are preferably polyamide fibers, e.g. nylon, and at least one continuous elastic filament that is preferably spandex (or elastane), e.g. segmented polyurethanes of spandex type.

The continuous elastic filament can be present in the in the form of one or more individual filaments or one or more coalesced grouping of filaments. However, it is preferred to use only one coalesced grouping of filaments. Whether present as one or more individual filaments or one or more coalesced groupings of filaments the overall linear density of the elastic filament(s) in the relaxed state is preferably between 8 and 560 dtex with a preferred linear density range between 17 and 560 dtex, more preferably between 22 and 220 dtex, even more preferably between 40 and 220 dtex, even between 44 and 220 dtex most preferably between 44 and 156 dtex.

Preferred continuous elastic filaments include olefin-based stretch fibers, e.g. DOW XLA; bi-component polyester based fibers, e.g. T400 from DuPont; and texturized polyesters or nylons. Texturizing is a process whereby partially oriented filament yarns of polyester or nylon are stabilized through heating and drawing to produce crimped and elastic continuous filament yarns. A more preferred continuous elastic filament is a filament manufactured from a long chain synthetic polymer comprising a segmented polyurethane. Preferably, said polymer comprises at least 85% by weight of segmented polyurethane. More preferably, the segmented polyurethanes are of spandex type. Among the segmented polyurethanes of the spandex type are those described in, for example, U.S. Pat. Nos. 2,929,801; 2,929,802; 2,929,803; 2,929,804; 2,953,839; 2,957,852; 2,962,470; 2,999,839; and 3,009,901.

The fabric according to the present invention preferably comprises a warp yarn A that substantially consists of cotton, a warp yarn B that is a spun yarn with an amount of between 10-50 wt % of individual UHMWPE staple fibers and the weft yarn that comprises between 33-66 wt % of individual yarns comprising a UHMWPE spun yarns. Such a composition results in an optimized balance between improved wearing comfort and abrasion resistance of the fabric according to the present invention, in particular even at lower amounts of UHMWPE yarns in the woven fabric.

The yarns present in the fabric may each individually comprise at least one additive selected from the group comprising pigment, dyes, antioxidants, anti-statics and/or a combination thereof. As commonly practiced in the art, such additives can be used to overcome deficiencies of the woven fabric despite the above cited material and technology choices. The additives can be applied to the fabric by for example impregnation or coating of the fibers, yarns or fabrics at different stages in the production process as well as added to the synthetic fiber(s) during their synthesis process. Such additives are well known in the art. The skilled person can readily select any suitable combination of additives and additive amounts without undue experimentation. The amount of additives depends on their type and function. Generally, these amounts will be from 0 to 2 wt % based on the total composition of the fabric.

A fabric according to the invention is excellently suitable for manufacturing of clothing, lining, sport apparel, and gloves. Preferably the fabric according to the invention is used for the manufacturing of work clothing and leisure clothing where good abrasion properties are required for comfortable and light clothes. Hence further embodiments of the invention are the use of the fabric of the invention in the manufacture of clothing, lining, sport apparel, and gloves. A further embodiment of the invention are products comprising the fabric according to the invention wherein said product is selected from a group comprising clothing, lining, sport apparel, and gloves. The high abrasion resistance of the woven fabric according to the invention enable making motorcycle wear, including jeans.

Test methods as referred to herein include:

Tensile strength, and modulus, of fibers are suitably determined on multifilament yarns as specified in ASTM D885M, using a nominal gauge length of the fiber of 500 mm, a crosshead speed of 50%/min and Instron 2714 clamps, of type Fiber Grip D5618C. For calculation of the strength, the tensile forces measured are divided by the titer, as determined by weighing 10 meters of fiber; values in GPa are calculated assuming the natural density of the polymer, such as 0.97 g/cm$^3$ for UHMWPE.

Intrinsic viscosity, IV, may be determined according to ASTM D1601 (2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration.

Abrasion resistance was measured by using the standard method as described in prEn17092-1:201.

EXAMPLES

Woven fabrics were produced using double weave beam technology providing 2 warp yarns: warp yarn A (outer layer) and warp yarn B (inner layer) and a weft yarn in a 1/3 twill arrangement. Different yarn compositions have been employed as warp yarn A, warp yarn B and weft yarn, forming single layer fabrics with outer side and inner side:

Yarn I: Ne9.5/1 100% cotton spun yarn

Yarn II: Nm34/2 100% Dyneema® SK75 spun yarn

Yarn III Nm21 Dyneema®/Nylon/Spandex 66/33/5 wt %, based on the total amount of Yarn III, i.e. i) individual yarns 34 Nm (294 dtex) Dyneema® SK75 spun yarn, and ii) individual yarns of elastane continuous filaments (Spandex, 40 denier/3 filaments), with the elastane yarns being covered by Nylon 6,6 individual yarns (78 dtex, 23 filaments texturized), with i) and ii) being twisted together to form a 476 dtex (Nm21) Yarn III containing 62 wt % Dyneema® SK75 yarn, 33 wt % Nylon 6,6 yarn, 5 wt % elastane yarn, based on the total composition of Yarn III.

Yarn IV: Nm21 cotton spun yarn

TABLE 1

| Samples | Warp yarn A | Warp yarn B | Weft yarn | Amount UHMWPE yarn, wt %, based on the total composition of the woven fabric | Abrasion Resistance |
|---|---|---|---|---|---|
| Comp. Ex. A | Yarn I | Yarn II | Yarn III | 52 | Level AA |
| Example 1 | Yarn I | Yarn I and II (1:1) | Yarn III & IV (1:1) | 25 | Level AA |

Table 1 clearly shows that the woven fabric according to the present invention (Example 1) reaches the same abrasion resistance level (A) the Comp. Ex. A, by using with only half of the amount of UHMWPE yarns. By using lower amount of UHMWPE yarn, the wearing comfort for the woven fabric according to the present invention also increases.

The invention claimed is:

1. A woven fabric comprising a weft yarn and two warp yarns A and B, wherein the weft yarn comprises a combination of:

individual yarns comprising ultrahigh molecular weight polyethylene (UHMWPE) yarns, and individual natural yarns, wherein the amount of yarns comprising the UHMWPE yarns in the weft yarn is between 33 and 66 wt % of the total amount of weft yarn;

the warp yarn A comprises at least 50 wt % of a natural fiber; and wherein the warp yarn B comprises of a combination of:

individual UHMWPE yarns, and individual natural yarns, wherein the amount of UHMWPE yarns is between 10 and 50 wt % of the total amount of the warp yarn B; and wherein the fabric has an outside layer comprising the warp yarn A and an inside layer comprising the warp yarn B and the outside and inside layer being at least partially interconnected by the weft yarn.

2. The woven fabric of claim 1, wherein at least a part of the amount of the yarns comprising UHMWPE yarns in the weft yarn is between 40 and 60 wt % and is arranged in alternating fashion with individual natural yarns.

3. The woven fabric of claim 1, wherein at least a part of the UHMWPE yarns in the warp yarn B is arranged in alternating fashion with individual natural yarns.

4. The fabric of claim 1, wherein warp yarn A additionally comprises natural fibers selected from the group consisting of cotton, hemp, wool, silk, jute, linen and/or synthetic fibers including polyamides, polyesters, polytetrafluoroethylene, polyolefins, polyvinyl alcohols and polyacrylonitriles.

5. The fabric of claim 1, wherein the warp yarn B is a spun yarn.

6. The fabric of claim 1, wherein the weft yarn comprises individual yarns comprising UHMWPE spun yarns.

7. The fabric of claim 1, wherein the warp yarn B further comprises at least one third fiber selected from the group comprising cotton, hemp, wool, silk, jute, linen and synthetic fibers of polyamides, polytetrafluoroethylene, polyesters, polyolefins, polyvinyl alcohols and polyacrylonitriles.

8. The woven fabric of claim 1 wherein the UHMWPE yarns in the warp yarns B are arranged in a clustered manner, comprising clusters of between 1-20 individual UHMWPE yarns.

9. The woven fabric according to claim 1, wherein the warp yarn B consists of a combination of individual UHMWPE yarns and individual natural yarns, the amount of UHMWPE yarns being between 10 and 50 wt % of the total amount of warp yarn B.

10. The fabric of claim 1, wherein the warp yarn A substantially consists of cotton, the warp yarn B is a spun yarn substantially consisting of UHMWPE staple fibers and natural staple fibers and the weft yarn comprises of individual natural yarns and individual yarns comprising UHMWPE yarns.

11. The fabric of claim 1, wherein the weft yarn comprises individual natural yarns and individual yarns comprising UHMWPE yarns, preferably UHMWPE spun yarns, and synthetic fibers, such as polyamide fibers, and/or at least one continuous elastic filament.

12. The fabric of claim 1, wherein the individual natural yarns are selected from the group consisting of cotton, hemp, wool, silk, jute, linen.

13. The fabric of claim 11, wherein the synthetic fibers are selected from the group consisting of polyamides, polytetrafluoroethylene, polyesters, polyolefins, polyvinyl alcohols and polyacrylonitriles.

14. A product comprising the fabric according to claim 1, wherein said product is selected from a group comprising clothing, lining, sport apparel, and gloves.

15. A textile product which comprises the fabric of claim 1.

* * * * *